United States Patent [19]

McKee

[11] Patent Number: 4,829,618

[45] Date of Patent: May 16, 1989

[54] COASTER/OPENER FOR BEVERAGE CONTAINERS

[76] Inventor: Carl B. McKee, 29971 Homedale, New Hudson, Mich. 48165

[21] Appl. No.: 236,234

[22] Filed: Aug. 25, 1988

[51] Int. Cl.[4] ..... B25F 1/00; B67B 7/44

[52] U.S. Cl. ..... 7/151; 81/3.09; 81/3.4; 81/3.55; 248/346.1

[58] Field of Search ..... 7/151; 81/3.07, 3.09, 81/3.4, 3.55, 3.39; 248/346.1, 346; D8/34

[56] References Cited

U.S. PATENT DOCUMENTS

| | | | |
|---|---|---|---|
| D. 232,415 | 8/1974 | Matsumoto | 81/3.55 |
| D. 261,854 | 11/1981 | Nielsen | 81/3.4 |
| 937,850 | 10/1909 | Parker | 81/3.09 |
| 4,373,223 | 2/1983 | Miller | 7/151 |
| 4,414,865 | 11/1983 | Brooks et al. | 81/3.09 |

FOREIGN PATENT DOCUMENTS

| | | | |
|---|---|---|---|
| 2264765 | 10/1975 | France | 81/3.55 |

*Primary Examiner*—Roscoe V. Parker

*Attorney, Agent, or Firm*—Krass & Young

[57] ABSTRACT

A coaster for supporting beverage cans that is also operative to open both tab topped beverage cans and twist-off cap bottles. The coaster is a square body with parallel top and bottom surfaces and relatively short sides that are normal to both the top and bottom surfaces. A circular depression, whose surface serves to support beverage cans, is formed on the top surface. A circular dome is formed on the central portion of the depression's surface. The coaster also includes a slot, for opening tab topped beverage cans, formed on the corner of one of its sides. The coaster also includes a circular depression, having a circle or radially inwardly extending projections on its inner wall, centrally formed on its bottom surface. This depression serves to remove twist-off bottle caps from beverage bottles.

9 Claims, 2 Drawing Sheets

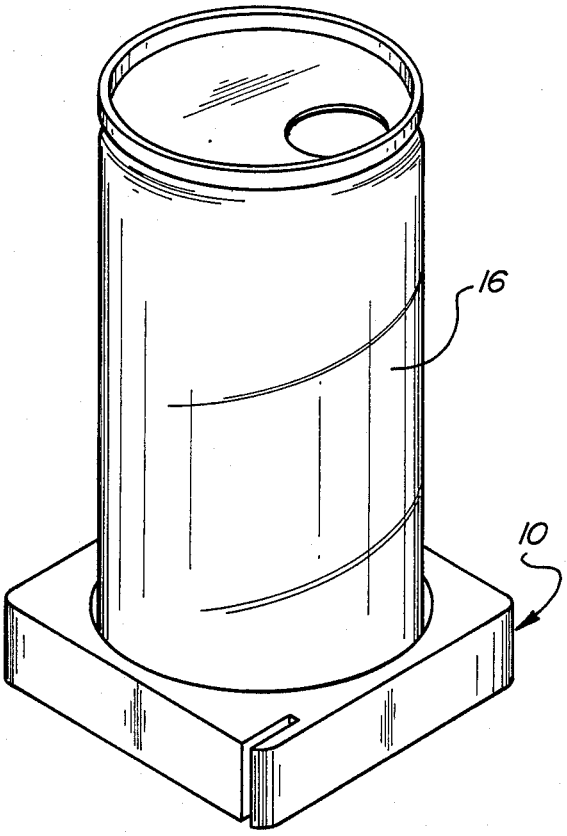
FIG. 1
FIG. 2
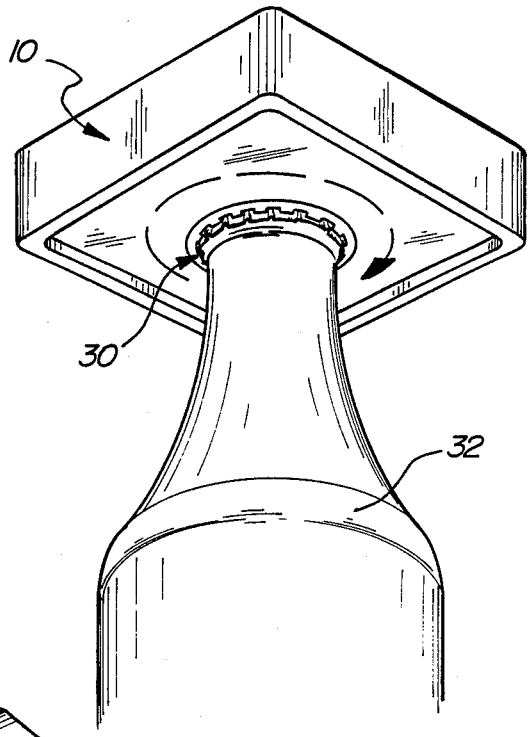
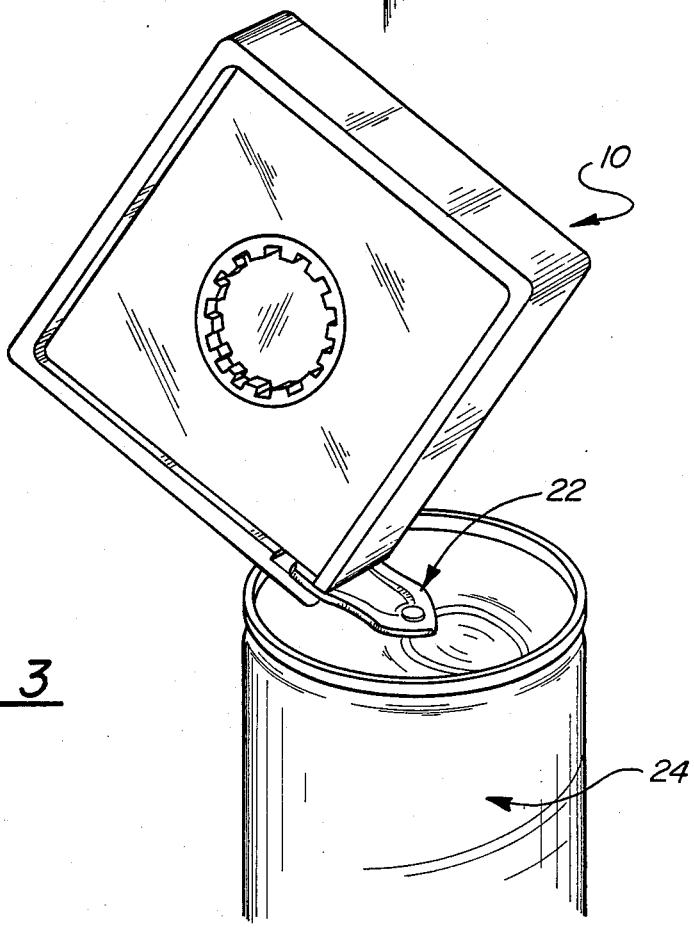
FIG. 3

COASTER/OPENER FOR BEVERAGE CONTAINERS

BACKGROUND OF THE INVENTION

1. Field of the Invention

This invention relates to a coaster for beverage containers that is also operative to open several different types of beverage containers.

2. Description of the Related Art

Coasters for beverage containers have long been used to protect table surfaces by preventing condensation or spills from coming in contact with the table surface. Also, many multi-purpose tools for opening a plurality of different containers have been developed. The patents in this area make evident the many attempts to create such a tool that is practical, convenient, and neat in appearance.

Previous U.S. patents disclosing devices which feature the combination of different container opening tools include U.S. Pat. Nos. 4,455,894, 4,373,223, 4,642,827, 4,667,544, 4,463,631, 4,412,464, and 4,409,863. The devices disclosed in these patents range from large multi-purpose tools to key chains and lighter cases that are combined with can and bottle opening tools.

SUMMARY OF THE INVENTION

The present invention is directed towards providing a device with the capability of opening and supporting several different forms of beverage containers that also has an appealing appearance, is simple in construction, and is convenient to use.

The present invention relates to a coaster for supporting beverage containers that also includes several tools for opening cans and bottles. The coaster's body has parallel top and bottom surfaces, with relatively short sides normal to both the top and bottom surfaces.

The bottom surface of the coaster body includes a circular depression in its center. A series of spaced projections that extend radially inwardly are formed on the inner wall of the depression. The depression is adapted to receive and engage a twist-off bottle cap so that, when engaged, the cap may be removed by twisting the coaster about the bottle.

The preferred embodiment of the present invention also includes a slot formed on a side of the coaster body adapted to engage the free end of an opening tab on a tab-top can in order to open the can. The slot has an opening that extends across the minor dimension of the coaster's side. The slot extends from the opening in the side surface, inwardly into the body of the coaster. The slot has a pair of opposed inner walls and is located on the coaster so that it forms a narrow elongated projection adjacent to one of the inner walls. The slot may be positioned to encompass a tab on the top of a can with the narrow elongated projection inserted between the tab and the can top, while keeping the slot at a relatively small angle to the top of the can. The can may then be opened by pivoting the coaster upwardly.

In the preferred embodiment of the present invention, the top surface of the coaster includes a circular depression adapted to receive and support the bottom end of a beverage can. A circular symmetric convexly shaped dome is formed on the central portion of the depression. This dome adds to the appearance of the coaster and serves to provide a supporting surface for the bottoms of beverage cans having bottom surfaces which are concavely curved in their centers. In this embodiment, the bottom surface of a can placed on the coaster is in complete abutment with the surface in the depression.

In the preferred embodiment, the coaster is formed of a rigid plastic. Alternatively, the coaster may be formed of metal.

BRIEF DESCRIPTION OF THE DRAWINGS

The objectives, advantages, and applications of the present invention will be made apparent by the following detailed description of the preferred embodiment of the invention. The description makes reference to the accompanying drawings in which:

FIGS. 1, 2, and 3 are perspective views of the preferred embodiment of the present invention in its three different modes of use;

DETAILED DESCRIPTION OF THE PREFERRED EMBODIMENT

Figure 4:
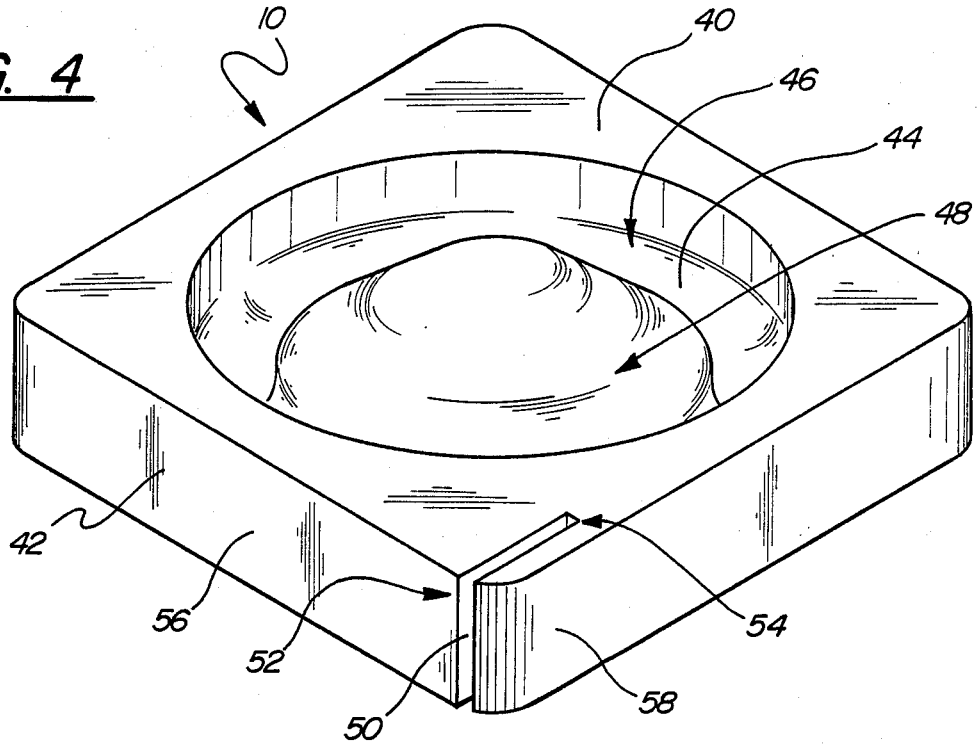
FIG. 4 is a perspective view from the top of the present invention.
Figure 5:
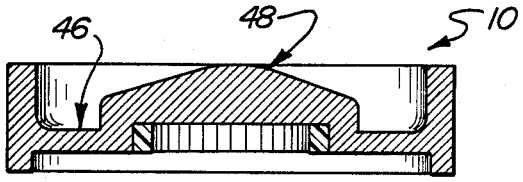
FIG. 5 is a cross sectional view of the present invention.

FIG. 1 is a perspective view of the preferred embodiment of the present invention being used as a coaster. A coaster 10 is used by a user to support a beverage can 16 while it is not in use. FIG. 2 indicates a second usage of the present invention. The bottom surface of the coaster 10 is used to remove a twist-off cap 30 from a beverage bottle 32. Finally, FIG. 3 indicates a third usage of the present invention. In this mode, the coaster 10 is used in conjunction with a tab 22 in order to open a beverage can 24.

FIG. 4 provides a view of the top surface, indicated at 40, of the coaster 10. In the preferred embodiment, the coaster 10 is of a square shape and has parallel top and bottom surfaces, with relatively short sides 42 that are normal to both the bottom and top surfaces. The coaster is preferably formed of a rigid plastic. Alternatively, the coaster may be formed of stainless steel.

A circular depression, generally indicated at 44, is formed on the top surface 40 of the coaster. In the preferred embodiment of the present invention, the surface 46 of the circular depression 44 has a circular and symmetrical convexly shaped dome 48 formed on its center. The depression 44 and the dome 48 are adapted to receive the bottom end of a typical beverage can. Such cans have bottom surfaces that are concavely shaped in their centers in a manner opposite to the central portion 48 of the depression 44. Hence, the depression 44, along with its central portion 48, serve to support a beverage can by providing contact with the entire bottom surface of the can. The central portion 48 also adds to the aesthetic appeal of the present invention.

A slot, indicated at 50 is formed in a corner of one side of the coaster 10. The slot extends inwardly from an opening in the side's surface 52 to a closed end 54. The slot is adapted to receive the free end of a tab of the type connected to opening systems on the tops of beverage cans. The slot separates the coaster into two portions, a portion 56 above and adjacent the upper inner wall of slot 50 and a relatively thin portion 58 below and adjacent the bottom inner wall of the slot. In use, as indicated in FIGURE 2, a user may bring the coaster to a position such that the slot 48 is encompassing the free end of a tab on the top of a beverage can, and so that the portion 58 is wedged between the tab and the top of the can. In this positon, the slot is tilted by a relatively small angle from the top surface of the can. The user may then open the can by rotating the coaster upwards and about the point of connection between the tab and the can.

Figure 6:
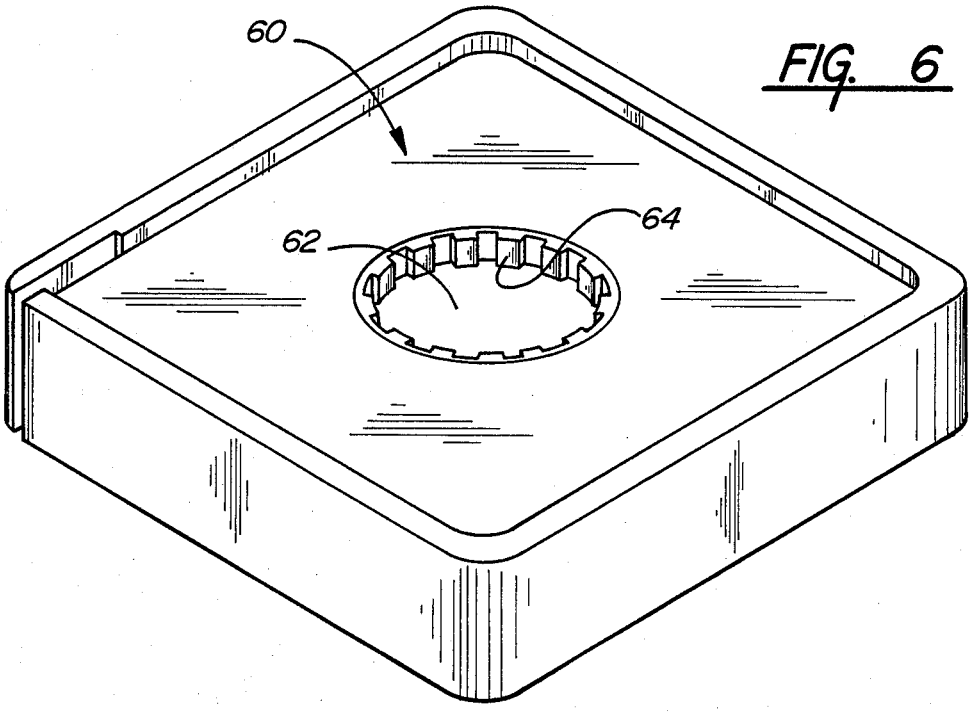
FIG. 6 is a perspective view of the bottom of the present invention.

FIG. 6 provides a view of the bottom surface 60 of the present invention. A circular depression 62 is formed on the center of the suface 60. A circle of radially inwardly extending projections 64 is formed on the inner wall of the depression 62. The depression is adapted to receive a twist-off cap that is securely fastened to a beverage bottle. The projections serve to engage the sides of the twist-off cap. In use, a user may remove a twist-off cap from a bottle by encompassing the cap in the depression 62 and then rotating the coaster about the bottle. The bottom surface 60 may also serve as a coaster for a beverage bottle or any can that does not fit properly into the depression on the top surface.

In an alternative embodiment, the coaster may be of a circular shape. In this embodiment, the slot may be positioned so that it is parallel to a line that is tangent to the outer edge of the circular coaster, and so that the slot forms a narrow elongated projection between the parallel line and one side of the slot. The elongated narrow projection can be inserted between an opening tab and the top of the can so that the can may be opened by pivoting the coaster upwardly.

Having thus described my invention, I claim:

1. A coaster for beverage containers, including:

a body having substantially parallel top and bottom surfaces, with relatively short sides extending between and normal to said top and bottom surfaces;

a central circular depression formed on said bottom surface, the inner side surface of said depression having a plurality of spaced projections extending radially inwardly, said circular depression being adapted to receive and engage a twist-off bottle cap;

a slot formed on a side of said body, extending inwardly from an opening in the surface of said side, said slot being adapted to receive the free end of an opening tab on a tab-top container and comprising an opening along the minor dimension of said side of said body and said slot separating said body into two portions, a first relatively thin portion below and adjacent to said slot and a second portion above and adjacent to said slot, such that a user holding said coaster can position said slot to encompass a opening tab on a closed can so that said first portion is under said tab and said slot is at a relatively small angle to the can top, allowing said can to then be opened by pivoting said coaster body upwardly and about the point of connection of said tab to said can top;

whereby said coaster may be used either to support a beverage container, to open bottles having twist-off caps, or to open beverage cans of the type having tab-top openers.

2. The device of claim 1 further including a circular depression formed on said top surface and being adapted to receive and support the bottoms of said cylindrical beverage cans.

3. The device of claim 2 wherein said circular depression formed on said top surface further includes a central circular and symmetrical convexly domes portion formed in said depression so that said depression is adapted to fit into the bottoms of beverage cans of the type having concavely curved bottoms.

4. The device of claim 3 wherein said coaster is formed in a square shape.

5. The device of claim 3 wherein said coaster is formed in a circular shape.

6. The device of claim 1 wherein said coaster is formed in a square shape.

7. The device of claim 1 wherein said coaster is formed in a circular shape.

8. The device of claim 1 wherein said coaster is formed of rigid plastic.

9. The device of claim 1 wherein said coaster is formed of metal.

* * * * *